United States Patent [19]

Wright

[11] Patent Number: 5,035,522

[45] Date of Patent: Jul. 30, 1991

[54] RIBBON REINKING MACHINE

[75] Inventor: John G. Wright, Bristol, United Kingdom

[73] Assignee: Inkwell (UK) Limited, Bristol, United Kingdom

[21] Appl. No.: 536,196

[22] Filed: Jun. 11, 1990

[30] Foreign Application Priority Data

Jun. 9, 1989 [GB] United Kingdom ..... 8913354

[51] Int. Cl.[5] ..... B41J 27/12

[52] U.S. Cl. ..... 400/197; 250/559; 250/562

[58] Field of Search ..... 400/197, 198, 199, 200, 400/201, 202, 202.1, 202.3, 202.4; 118/264, 270, 679, 683, 688, 691, 693; 427/141; 250/559, 571, 562

[56] References Cited

U.S. PATENT DOCUMENTS

| | | | |
|---|---|---|---|
| 3,445,670 | 5/1969 | Westdale et al. . | |
| 4,088,800 | 5/1978 | Nicholson | 400/197 |
| 4,123,569 | 10/1978 | Peterson et al. | 427/141 |
| 4,126,715 | 7/1978 | Schiffmacher et al. | 427/141 |
| 4,390,294 | 6/1983 | Castro | 400/196.1 |
| 4,530,612 | 7/1985 | Butera et al. | 400/197 |

FOREIGN PATENT DOCUMENTS

| | | | |
|---|---|---|---|
| 0100776 | 8/1982 | European Pat. Off. . | |
| 3325917 | 2/1985 | Fed. Rep. of Germany | 400/200 |
| 55-0065585 | 5/1980 | Japan | 400/202 |
| 0078857 | 6/1981 | Japan | 118/691 |
| 0015991 | 1/1982 | Japan | 400/197 |
| 58-0132580 | 8/1983 | Japan | 400/202.4 |

OTHER PUBLICATIONS

"Control of Coating Thickness", IBM Technical Disclosure Bulletin, vol. 26, No. 6, 11/83, pp. 2669-2672.

"Patent Abstracts of Japan", vol. 11, No. 330 (M-636)(2777), Oct. 28, 1987, & JP-A-62 111778 (NEC), 05-22-87.

*Primary Examiner*—Eugene H. Eickholt

*Attorney, Agent, or Firm*—Kane, Dalsimer, Sullivan, Kurucz, Levy, Eisele and Richard

[57] ABSTRACT

Used computer printer, W.P. or typewriter ribbons are reinked using a machine having a ribbon spool or cartridge loading station, an ink applicator and opto-electric sensors disposed one each side of the applicator along the ribbon path. Manual or automatic control inresponse to the sensor output signals representative of the density of ink (darkness), enables the application of a quantity of ink sufficient to produce a desired ink density along substantially the entire length of the ribbon.

11 Claims, 4 Drawing Sheets

RIBBON REINKING MACHINE

This invention relates to a method and apparatus for inking a ribbon particularly used computer printer, word processor or typewriter ribbons.

Such ribbons whether "spooled", that is to say, of the reel-to reel-type or "cartridged" ribbons in which a continuous loop of ribbon is packed within the cartridge or cassette have a limited effective working life. They are useful only so long as there is ink on them to be transferred by impression to the paper. When the printing produced becomes unacceptably light and pale, the spooled or cartridged ribbon is removed from the machine for disposal and replaced by another.

This invention is particularly, though not exclusively, applicable to fabric ribbons. Such ribbons are available for most types and makes of machine but are somewhat more expensive than carbon plastic ribbons which are widely used for reasons of economy. This difference in capital cost is, however, small compared with the total cost of replacement spooled or cartridged ribbons.

One object of the present invention is to reduce operating costs by enabling used ribbons, particularly fabric ribbons to be reinked to at least the standard of a new ribbon. Another object is to reduce the need for and problems associated with disposal of ribbons and their carriers which remain in good working condition, even though ink on the ribbon may have been exhausted.

According to the present invention we propose a method of inking a ribbon comprising feeding the ribbon relative to an ink applicator and opto-electric sensing means generating a signal representative of the density of ink on the ribbon, comparing the said signal with a predetermined threshold level representative of the desired ink density, and terminating the procedure when the comparison indicates that substantially the entire length of the ribbon bears the desired ink density.

Also according to the invention we propose apparatus for inking a ribbon comprising an ink applicator, opto-electric sensing means for generating a signal representative of the density of ink on the ribbon, means for feeding the ribbon relative to the ink applicator and the sensing means and means enabling the said signal to be compared with a predetermined threshold level representative of the desired density of ink on the ribbon, whereby, in use, inking can be terminated when substantially the entire length of the ribbon bears the desired ink density.

Inking of ribbons, more particularly the reinkinq of fabric ribbons, in accordance with the invention may be controlled manually by a machine operator or automatically by means of a micro-processor or CPU connected and responsive to the opto-electric sensing means.

For manual control, the signal representative of ink density is monitored by means of a meter and the ribbon is fed through as many passes as necessary for the observed signal level to reach a predetermined level known (by experience or calibration using a new ribbon) to the machine operator.

Alternatively, the ribbon feed rate and/or ink deposition rate may be controlled automatically in response to the said ink density signal in order that reinkinq may be achieved in a single pass.

Embodiments of the present invention will now be described by way of example with reference to the accompanying drawings in which.

Figure 1:
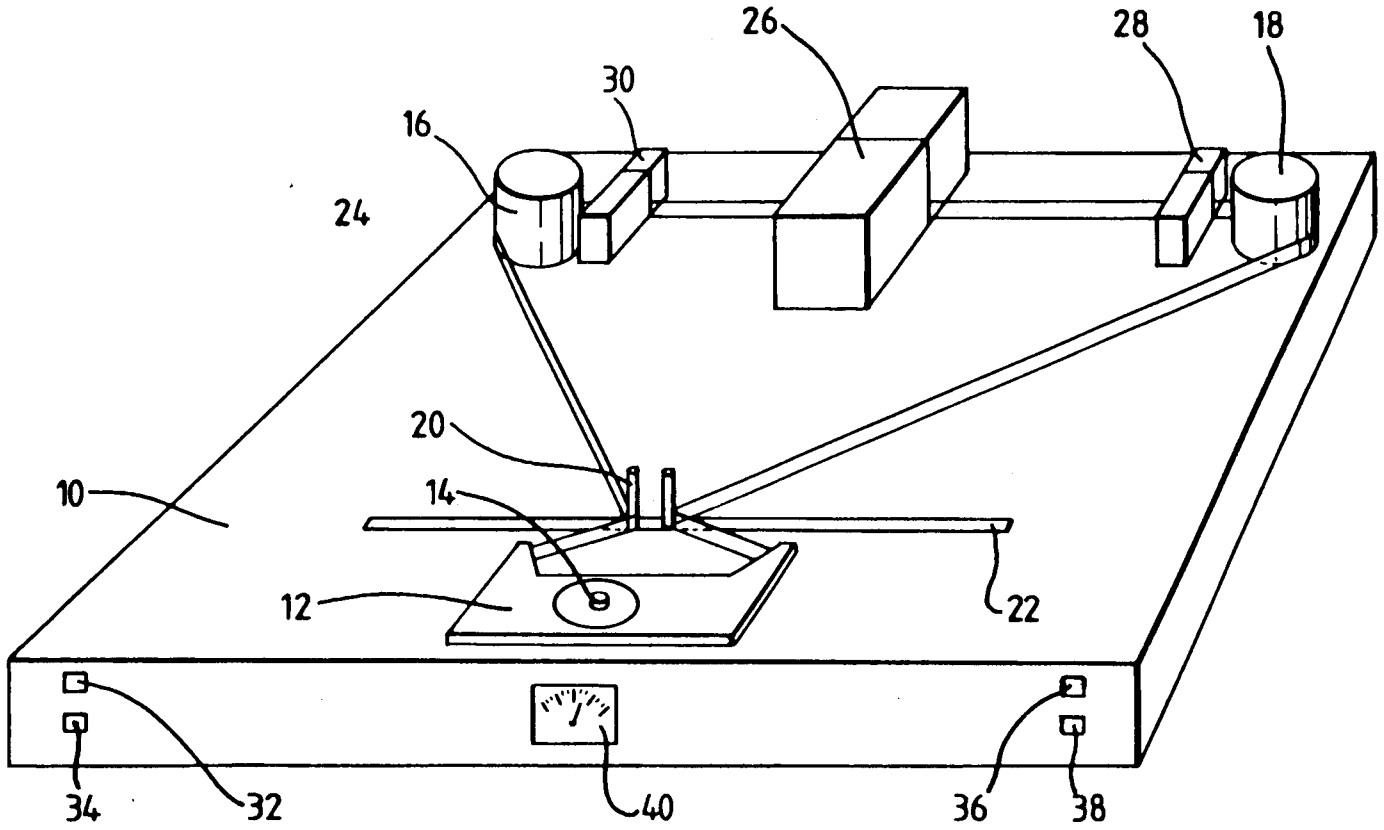
FIG. 1 is a schematic perspective view of a ribbon re-inking machine having a cartridge ribbon loaded ready for re-inking.

The ribbon re-inking machine of FIG. 1 has a workbed 10 housing an electronic control circuit, and providing a platform on which a ribbon cartridge 12 can be loaded as shown with its integral drive 14 in engagement with a reversible drive shaft driven either directly or via suitable gearing, by an electric motor (not shown) beneath the platform. Rotable guide rollers 16, 18 and adjustable spring loaded tensioning guides 20 which are movable away from each other against a spring bias longitudinally of the slot 22, are provided to hold taut ribbon 24 that is drawn from the cartridge 12 and threaded around the guides 20 passing through an ink applicator 26 which in this embodiment is a pneumatic spray booth, and opto-electric sensors 28, 30 disposed one on either side of the applicator 26 in the path of the ribbon 24 between the rotatable guide rollers 16 and 18.

In the case of a ribbon cartridge containing a continuous loop of ribbon the entire length of the ribbon can be fed through the applicator for any desired number of passes without the need to reverse the drive, It will be readily understood, however, that for a spooled ribbon the feed direction is reversed, preferably by reversing the direction of the motor, between passes. In the following, reference will be made to the procedure for re-inking a cartridge ribbon.

First of all the direction of rotation of the drive motor is selected by means of a switch 32 to correspond with the drive direction indicated on the ribbon cartridge and, by means of a test switch 34 the ribbon can be set in motion enabling the correct direction of rotation, proper engagement of the drive shaft with integral drive 14 of the cartridge 12 and the general condition of the ribbon 24 to be checked. A start button 36 is then pressed to initiate controlled re-inking of the ribbon.

In the simplest form of machine only one of the two opto-electric devices 28 and 30 is needed; the device upstream (with respect to the feed direction of the ribbon) of the ink applicator, this being selected by means of a switch 38. The selected opto-electric device produces a signal that varies inversely in amplitude with the density of ink on the ribbon; the more ink there is on the ribbon the less light is transmitted therethrough. This signal can be connected to a meter 40, e.g. an ammeter, providing a display for the machine operator who is then able to make a comparison with a known predetermined meter reading or level representative of a desired ink density. The ribbon may be fed through the ink applicator as many times as necessary to achieve the desired meter reading.

Alternatively, the comparison is carried out automatically by means of a comparator responsive to the opto-electric sensor output and an adjustable threshold level that can be set as appropriate to a particular type and/or colour of ribbon being inked. The control unit including the comparator may be arranged so as to stop the drive motor when the predetermined threshold level has been reached.

Figure 2:
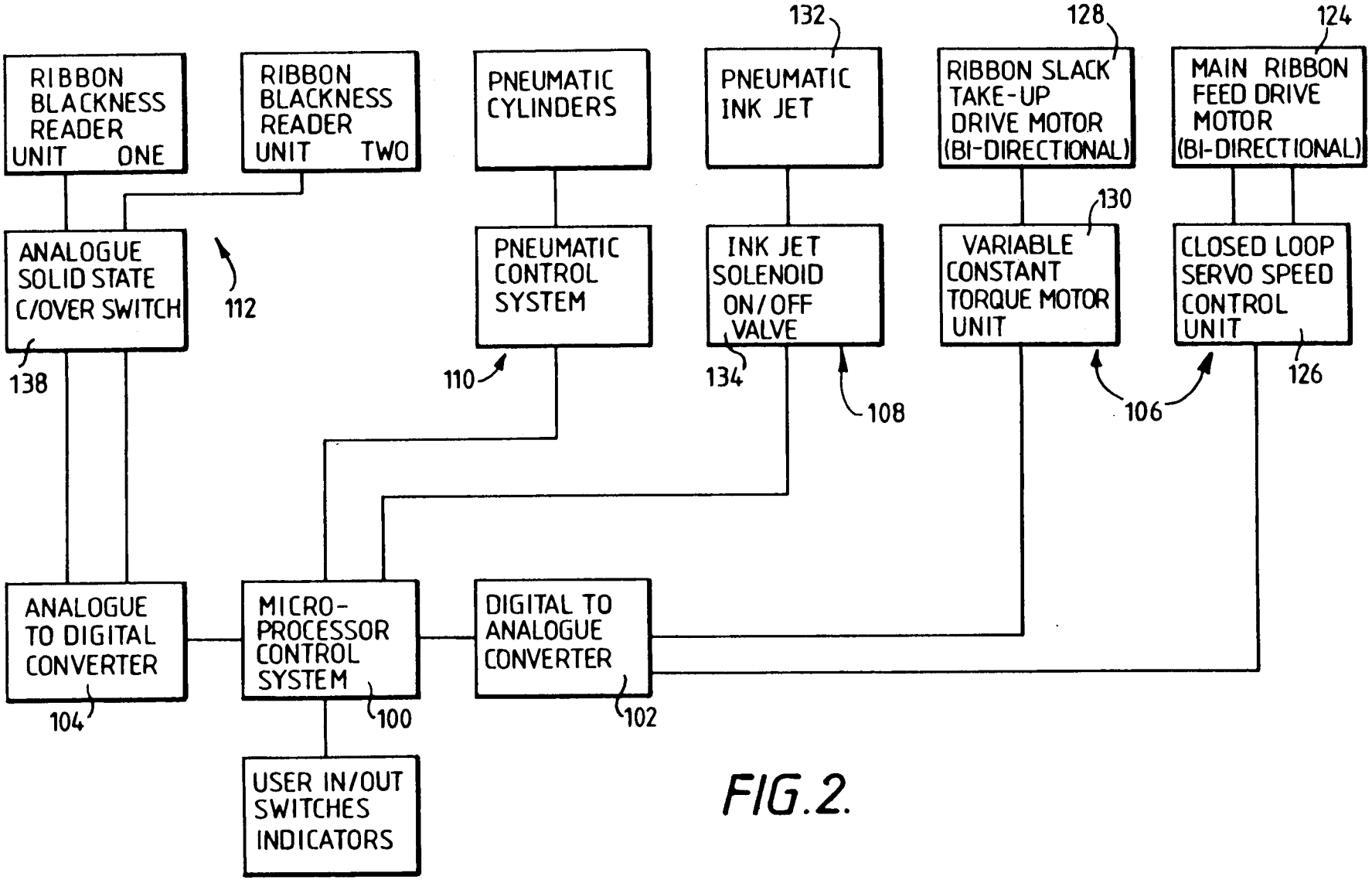
FIG. 2 is a block diagram of a control circuit for a preferred embodiment of ribbon re-inking machine.
Figure 3:
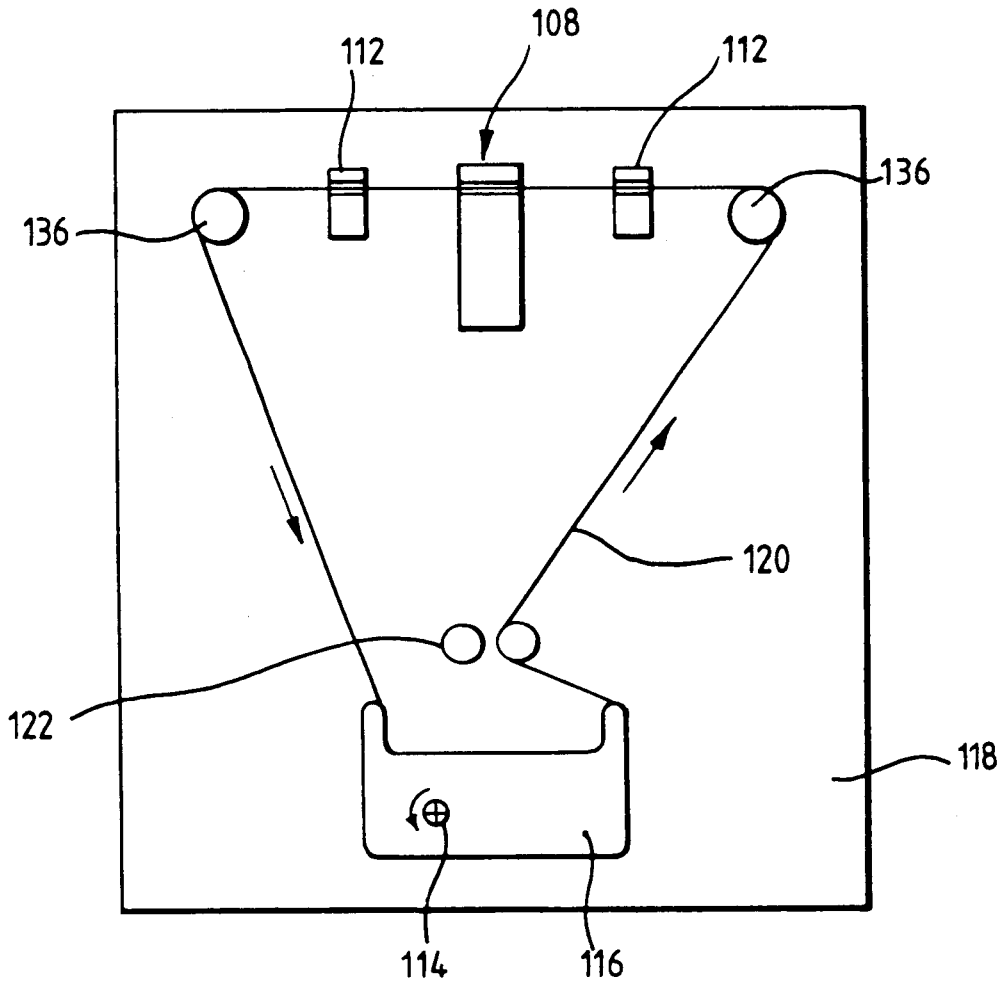
FIG. 3 is a diagram showing schematically the layout of a preferred embodiment of re-inking machine.
Figure 4:
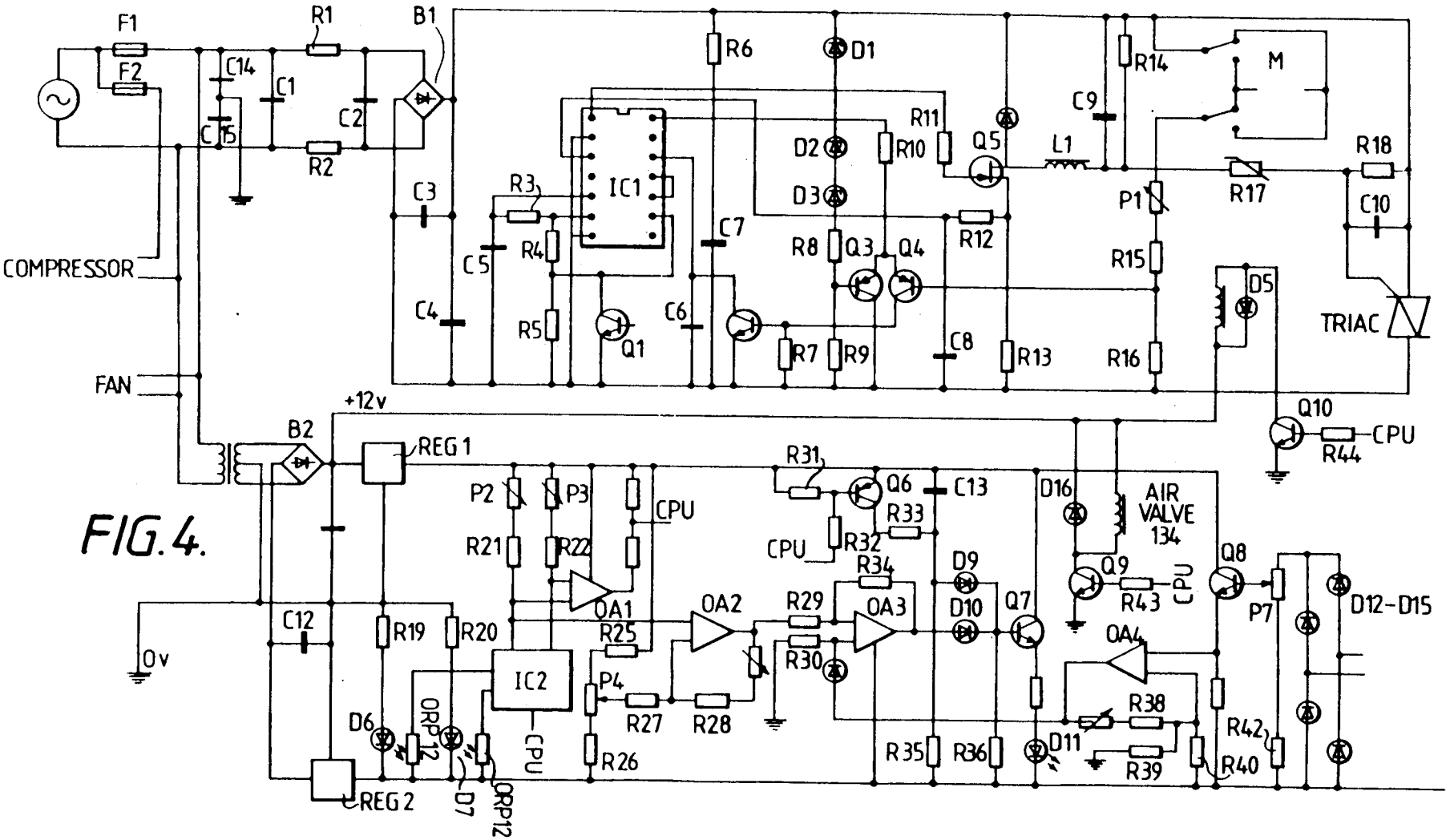
FIG. 4 is a detailed circuit diagram of the control circuit shown in FIG. 2.

In the preferred embodiment of FIGS. 2 to 4, the control unit incorporates feedback control of the ribbon speed and/or the rate at which ink is delivered onto the ribbon in the applicator so as to accommodate variations in ink density along the length of the tape and/or to enable re-inking to the desired density in a single pass. A control unit by which such control can be achieved is shown in the block diagram of FIG. 2 and the detailed circuit diagram of FIG. 4.

Referring first of all to FIGS. 2 and 3, the ribbon re-inking machine is under the control of a microprocessor or CPU 100, which is connected via analogue to digital convertors 102, 104, to a ribbon drive 106, ink applicator 108, optional pneumatic ribbon loading device 110 and opto-electric sensors 112. The ribbon drive 106 differs from that of the machine of FIG. 1 in so far that the integrated cartridge drive 114 is not used to draw ribbon from the cartridge; only to assist the reloading. This avoids undue wear so extending the useful life of the integrated cartridge drive enabling an increased number of reinking operations to which a cartridge may be subjected. As will be seen from the diagram of FIG. 3 (which is of a reinking machine not fitted with a pneumatic ribbon loading device), a ribbon cartridge 116 is loaded on the workbed 118 with the cartridge drive wheel 114 engaging a motor driven reversible drive spindle (not shown). Ribbon 120 is pulled from the cartridge and threaded between pinch rollers 122 and through the opto-electric sensors 112 and ink applicator 108. The pinch rollers 122 (one driven and one idle) are connected to be driven by a reversible main ribbon drive motor 124 controlled by a closed loop servo speed control unit 126. This arrangement provides the motive power needed to feed the ribbon 120 round the machine, the integrated cartridge drive 124/reversible drive spindle being driven by a separate (reversible) variable constant torque motor 128 under control of the CPU 100 and drive unit 130, and serving simply to take up any ribbon slack and reload the ribbon in the cartridge 116 as during normal use of the cartridge. Thus no substantial or undue load is applied to the integrated cartridge drive 114.

The ink applicator 108 comprises a spray booth which forms an ink reservoir and in which is a pneumatic ink jet 132 directed toward the ribbon and controlled in response to command signals from the CPU 100 by a solenoid on/off valve 134. The ink jet conveniently comprises a venturi through which a flow of air under pressure is introduced, the throat of the venturi being connected by a pipe to the ink reservoir whereby ink is drawn by suction from the reservoir and entrained (in the form of droplets) in the air stream. Any ink not impinging upon the ribbon strikes a baffle and drains therefrom into the sump or reservoir. It will be understood that for a given air supply pressure a substantially constant ink deposition rate is produced so that the deposition rate can be varied in a controlled fashion (by the CPU) by varying the available supply pressure.

The optional pneumatic ribbon loading device 110 may comprise pneumatic cylinders and associate linkage connected to move the guide rollers 136 from a retracted position near the cartridge loading station to the operative position shown in FIG. 3. A small amount of ribbon is drawn from the cartridge, threaded between the pinch rollers and looped around the guide rollers in their retracted position and as the guide rollers move to the operative position, the ribbon is automatically threaded through the opto-electric sensors and ink applicator. In the illustrated embodiment, reinking is effected with the ribbon disposed vertically but when automatic loading is required, it may be convenient to twist the ribbon so that it lies horizontally as it passes through the ink applicator and opto-electric sensors, so facilitating threading of the ribbon. Also in this connection, the applicator and sensors may be contained in a common housing arranged to be hinged or otherwise movable to permit insertion of the ribbon by the pneumatic loading device.

The outputs of the sensors 112 are connected via a change-over switch 138 the condition of which is set as appropriate to the selected direction of ribbon feed (normally indicated on the cartridge—see FIG. 3) as will be described in more detail below.

The upper half of FIG. 4 shows the circuitry to drive the main ribbon feed motor M which is a permanent magnet DC motor of about 100 watts rating. The lower half shows the means by which servo speed control of the motor M is achieved.

Mains voltage is rectified by a bridge rectifier B1 to provide around 360 volts maximum DC across capacitor C3 and C4 etc. with resistors R1, R2, and capacitor C1, C2, C14 and C15 forming a filter to prevent interference. A Motorola MC34129 current mode switching regulator integrated circuit IC1 is connected to a 12 volt supply via resistor R6 which drops the 360 volts to 12 volts clamped by a zener diode within the integrated circuit. The switching frequency of preferably 50 kHz is determine resistor R3 and capacitor C5, with a maximum duty cycle of 50%. Resistors R4 and R5 and R1 (which is part of an opto-isolator with diode D11 forming the other part) are the components which supply speed control information to the integrated circuit. Capacitor C6 is the "slow start timing" capacitor which ensures that the motor start gradually (over a few milli seconds) to prevent a power surge to the motor. Output pulses from the integrated circuit drive a high voltage field effect transistor Q5 used as the fast switching element. A positive pulse from the integrated circuit IC1 turns transistor Q5 on (closes the "switch") which causes a current to built up in inductance L1. This current also flows through capacitor C9 and resistor R13. The rising current through resistor R13 causes a rise in voltage which is monitored by integrated circuit IC1 via a simple spike filter comprising resistor R12 and capacitor C8. When the current has built to the maximum design value (determined by resister 13) as monitored by integrated circuit IC1, the output of ICl will revert to the negative state so turning off transistor Q5. At this instant, the current still flowing in inductance L1 causes the polarity of the voltage across L1 to reverse. This voltage is held to a finite value by the "catch diode" D4 which now becomes forward biased. The current in L1 is reducing but continues to supply a charge to capacitor C9. As the voltage on capacitor C9 rises the voltage applied to the motor rises and the motor begins to turn. The above sequence repeats and the voltage applied to the motor increases each time until the servo control circuitry indicates sufficient speed. The duty cycle of the output pulses of integrated circuit IC1 reduces to a point where equilibrium is reached.

Connections with the microprocessor or CPU 100 which may be a Motorola chip MC 68705 are indicated by "CPU".

The servo control section shown in the lower part of FIG. 4 works from low voltage isolated supplies. The mains transformer and rectifier B2 with regulators Reg 1 and 2 provide an unregulated supply of around +12 volts used to energise the motor direction relay and air valve and regulated supplies of +/−5 volts for the remainder of the circuit. So as to maintain constant brightness for the LED's lighting the ORP devices requires a regulated supply. Integrated circuit IC2 is an analog multiplexer used to swap over the "before" and "after" optoelectric sensors depending on the motor direction. This works just like the relay used to change the motor direction. The input to integrated circuit IC2 shown as "CPU" is aligned to a single chip micro computer. Hence regardless of the motor direction, the "before" sensor connects to resistor R22 at point B and the "after" or downstream sensor connects to resistance R2l at point A. Potentiometers P2 and P3 are used to set the correct D3 levels at points A and B such that when the conditions at both sensors are the same, the voltage at point B is fractionally higher than at point A. During the re-inking process, the ribbon passing whichever sensor is routed to A will be darker than the ribbon passing the other. This causes the voltage at A to be higher than the voltage at B. When the ribbon has been all the way round, there is a step change in ink density causing a higher voltage at B also. As previously stated, point B is set a fraction high to start with. The sequence of events is thus 1) No ribbon or uniform ribbon, good or not, (A<B)
2) Re-inking in progress (A>B);
3) The first re-inked portion has travelled all the way round (A<B)

Operational Amplifier QA1 is configured as a comparator. When A is less than B the output will be at a low level. When A is greater than B the output goes to a high level. Having just fitted a ribbon to be re-inked conditions at both sensors are substantially the same so A is less than B. The start button is pressed and after a short delay to allow the motor to reach speed, the microprocessor switches on the ink jet. A short while after this, the first portion to be inked passes the downstream sensor and A becomes greater than B, so causing the comparator output to go high. The computer monitors this comparator output, and when the first re-inked part reaches the upstream sensor, B becomes greater than A, the comparator output goes low again and this signals the microprocessor that re-inking is complete except for the last few inches. Hence after a short delay, the microprocessor switches off the ink jet and then switches off the motor.

A dark ribbon will cause a higher voltage at points A and B than a light one and hence, a desired ink density corresponds to a particular threshold voltage at point A (and B). Operational amplifier 0A2 has a gain set by potentiometer P5 and DC offset set by potentiometer P4. Thus a large variation in voltage is produced at the output of operational amplifier OA2 for a small change in ink density on the ribbon. The output voltage rises with increasing density. This is further amplified and inverted by operational amplifier 0A3, the output voltage of which passes through diode 10 to the emitter follower of transistor Q7 such that a rising output from operational amplifier OA3 causes rising current through transistor Q7, resistor R31 and diode D11. More current through diode D11 causes greater brightness and as this is optically coupled with transistor Q1, the impedance of Q1 reduces which in turn reduces the duty cycle of integrated circuit 1 so reducing motor voltage and therefore the speed.

It will be understood that this produces a closed loop servo system using ink density (ribbon darkness) as the feedback parameter. A lighter patch of ribbon causes the voltage at A to fall causing motor speed to fall so allowing more ink to be applied per unit area. Transistor Q6 and associated components provide a means by which the processor can override the servo mechanism to switch off the motor. Diodes D12–15 form a bridge rectifier to produce a DC voltage related to ribbon speed as sensed by a tachometer fitted to one of the guide pulleys (such as pulley in FIG. 1). The bridge ensures control information is of the same sense regardless of direction. The forward voltage drops of the diodes and the base-emitter junction of transistor Q8 prevent accurate sensing of very low speeds. The tachometer output is then buffered by transistor Q8 amplified and shifted in level by operational amplifier 0A4. If the output of this amplifier rises much above 0 volts then diode D8 becomes forward biased so applying more current to the opto-coupler via operational amplifier OA3, diode D10 and transistor Q7 etc. This tends to reduce motor speed. Thus ribbon speed is limited to some pre-determined safe maximum extent adjustable by means of potentiometers 6 and 7.

I claim:

1. A method of inking a ribbon comprising feeding the ribbon relative to an ink applicator and opto-electric sensing means generating a signal representative of the density of ink on the ribbon, comparing the said signal with a predetermined threshold level representative of the desired ink density, and terminating the procedure when the comparison indicates that substantially the entire length of the ribbon bears the desired ink density.

2. A method according to claim 1 wherein the ribbon to be inked is on a ribbon carrier.

3. A method according to claim 1 or claim 2 and comprising monitoring the signal representative of the density of ink on the ribbon, by means of a meter or other display, feeding the ribbon relative to the applicator and opto-electric sensing means for a number of passes until the observed signal level reaches the predetermined threshold level.

4. A method according to claim 1 or claim 2 and comprising adjusting the ribbon feed rate or otherwise adjusting the rate at which ink is applied to the ribbon, in response to the signal generated by the opto-electric sensing means.

5. A method according to claim 1 or claim 2 wherein the ribbon is fed relative to the applicator and sensing means in a plurality of passes, the feed direction optionally being reversed between passes.

6. Apparatus for inking a ribbon comprising an ink applicator, opto-electric sensing means for generating a signal representative of the density of ink on the ribbon, means for feeding the ribbon relative to the ink applicator and the sensing means and means enabling the said signal to be compared with a predetermined threshold level representative of the desired density of ink on the ribbon, whereby, in use, inking can be terminated when substantially the entire length of the ribbon bears the desired ink density.

7. Apparatus according to claim 6 wherein the means for feeding the ribbon comprises a loading station for receiving ribbon carries means with the carrier drive in engagement with a motor driven reversible drive.

8. Apparatus according to claim 6 or claim 7 wherein the feed means comprises pinch rollers between which a ribbon to be inked is threaded, one of the pinch rollers being connected to be driven by motor driven reversible drive means.

9. Apparatus according to claim 6 or claim 7 and comprising a meter or other display means connected to display the said signal representative of the ink density, enabling an operator to observe when the signal reaches the said predetermined threshold level.

10. Apparatus according to claim 6 or claim 7 wherein the feed means comprises a motor driven reversible closed-loop servo speed controlled drive under the control of a micro processor connected to receive signals form the opto-electric sensing means.

11. Apparatus according to claim 6 or claim 7 wherein the opto-electric sensing means comprises two sensors disposed in the path of the ribbon on opposite sides of the ink applicator.

* * * * *